US006140923A

United States Patent [19]

Lam

[11] Patent Number: 6,140,923

[45] Date of Patent: Oct. 31, 2000

[54] PURSE ALARM

[76] Inventor: Tai Peter Lam, 545 Dewey Blvd., San Francisco, Calif. 94116

[21] Appl. No.: 09/309,609

[22] Filed: May 11, 1999

[51] Int. Cl.[7] ..... G08B 13/14

[52] U.S. Cl. ..... 340/568.7; 340/571; 340/568.1

[58] Field of Search ..... 340/568.1, 568.2, 340/568.6, 568.7, 571; 200/61.13, 61.18, 61.67, 61.93; 24/590, 591

[56] References Cited

U.S. PATENT DOCUMENTS

| | | | |
|---|---|---|---|
| 3,815,118 | 6/1974 | McDonald | 340/571 |
| 3,851,326 | 11/1974 | Costa | 340/571 |
| 4,080,595 | 3/1978 | Rosen | 340/568.7 |
| 4,188,688 | 2/1980 | D'Orgelys | 24/591 |
| 4,633,232 | 12/1986 | Nelson et al. | 340/571 |
| 4,663,611 | 5/1987 | Humphrey | 340/542 |
| 4,698,615 | 10/1987 | Wilber | 340/984 |
| 4,776,188 | 10/1988 | Dalaba et al. | 70/49 |
| 5,124,685 | 6/1992 | Rankin | 340/568.2 |
| 5,343,981 | 9/1994 | Schroemges et al. | 182/231 |
| 5,353,609 | 10/1994 | Hall | 340/568.2 |

*Primary Examiner*—Daniel J. Wu
*Assistant Examiner*—Van T. Trieu
*Attorney, Agent, or Firm*—Thomas Schneck

[57] ABSTRACT

A security device is attachable to a purse, baggage or other personal items and is also attached, by a cable, to a fixed, relatively immobile object. A housing having the size of a measuring tape contains a reel having a few feet of cable wound thereon. The cable is similar to steel or heavy nylon fishing line, being lightweight, strong and not very visible. The reel has a built-in sound making device generating an alarm sound, such as would occur if an unauthorized individual attempts to remove the purse from the location. In addition to activating the alarm, the cable hinders the physical removal of the purse.

6 Claims, 2 Drawing Sheets

PURSE ALARM

TECHNICAL FIELD

The present invention relates to the field of alarm devices, and is directed particularly to security systems for portable goods.

BACKGROUND ART

Purses, baggage, and other portable goods carried on or about the person are often difficult to secure from theft. Often a person is seated at a restaurant, airport waiting area, or other place of public accommodation and has the need to feel that his or her baggage is secure from surreptitious activity. In addition, a person may wish to attend the restroom or speak with a ticket agent without carrying all of his or her personal belongings. For these situations, an unobtrusive and effective means for protecting baggage of all types would be ideal.

Many security measures have been previously disclosed that are designed to protect loose articles. Cables, chains, and locks have long been known in the art as methods to secure items against theft. These devices provide physical security through their strength, and deterrence through their obviousness. Chains and locks, however, are often cumbersome and difficult to use on a consistent basis, besides encumbering a person with added weight. Moreover, they do not hinder the determined thief using bolt-cutters or other devious means.

In many instances, these prior instrumentalities have often been improved with audible alarms designed to alert the owner of any violation of the goods. For instance, U.S. Pat. No. 4,663,611 to Humphrey describes an alarm lock that is designed for use on a bicycle. The invention embodies a cable affixed to a locking mechanism that contains an alarm. When the alarm is activated, wires within the cable complete a circuit, and if the cable is severed, the alarm will sound. A key lock engages the alarm and secures the cable. Retractable storage for the cable, however, is not provided.

A system for deterring theft of articles in a merchandise display was disclosed in U.S. Pat. No. 5,124,685 to Rankin. The inventor describes a cable affixed to the article being protected and also connected to a tensioned reel that is attached to a display case. If the cable is cut or broken, the reel retracts the cable past an actuator arm that in turn initiates an alarm. This system is designed to allow customers to handle the protected merchandise, and also to deter theft by physically restraining the items. If forcible means are used to remove the goods, the alarm would activate and draw the attention of the staff.

Alarms and tethered cable systems have been adapted to unique situations. For example, a casket jewelry guard is disclosed in U.S. Pat. No. 5,353,609 to Hall. The invention comprises a cabling system that tethers all of the deceased's jewelry to the coffin, thereby preventing the forcible removal of the items. In addition, the cables can be attached to an alarm device that would sound if the cables are pulled. Also, an alarm system designed to secure the canvas cover of a boat is described in U.S. Pat. No. 4,698,615 to Wilber. The system consists of cables attached to a canvas boat cover by clips. When the cover is pulled away from the boat, plungers are depressed, and the alarm sounds.

A wallet guard is disclosed in U.S. Pat. No. 4,080,595 to Rosen. The invention consists of an audible alarm device with a retractable chain. The device is designed to be attached to a person, perhaps on their belt, and the chain is connected by a clip to a wallet in a pocket. This arrangement requires the user to be physically tethered to the good being protected. When an attempted theft occurs, the chain is pulled from the housing, and the device activates an audible alarm.

An object of the invention is to provide a lightweight means for securing a purse or other baggage in a public area such as a restaurant or an airport waiting area. The means should be independent of the individual, so as to allow the person t o move about freely without the goods. Another object of the invention is to alert the owner of the protected goods when tampering or attempted theft occurs.

A further object of the invention is to provide a device that is small enough to be carried around and used on a daily basis.

SUMMARY OF THE INVENTION

The objects of the invention are met in a security apparatus that has a retractable cable contained in a housing that can be attached to a purse or luggage article or the like. In addition, the cable provides an anchor to be affixed to a stationary object, such as a table leg. This system enables a purse or article to be physically secured to a fixed object. The cable, however, while providing some means of physical immobilization, would only momentarily hinder a determined thief. A further aspect of this device is that an audible alarm signal is sounded as the cable is pulled. This action notifies the owner and people in the vicinity, that trouble is afoot.

BEST MODE OF CARRYING OUT THE INVENTION

Figure 1:
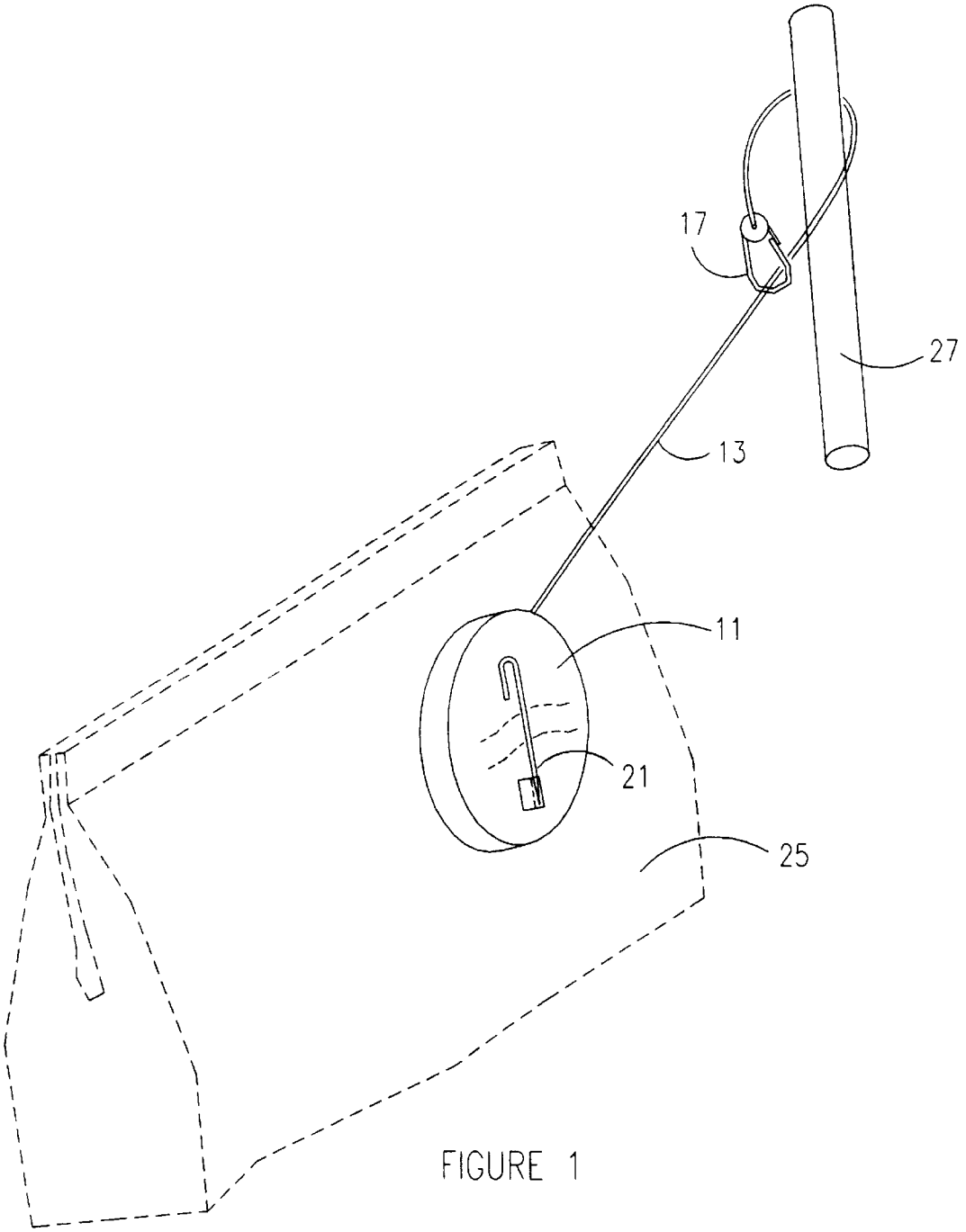
FIG. 1 is a side perspective view of a purse alarm of the present invention shown attached to the purse of a user and tethered to a table leg.

With reference to FIG. 1, housing 11, about the size of a measuring tape, is secured to a purse 25 by means of clasp 21 and the locking clip 17 is anchored to a table leg 27. The clasp 21 is affixed to the exterior of the housing 11. A cable 13 permits the attachment of the housing 11 to a purse 25 or other object being protected. Clasp 21 resembles a brooch pin. The cable 13, having an extent of a few feet and comparable to light steel or heavy nylon fishing line, terminates with a locking clip 17 for securing the cable 13 to a sturdy object, such as a table leg 27. A cable having the thickness of fishing line is barely visible.

The purse alarm is used by extracting the cable 13 from the housing 11, wrapping the cable 13 around a stationary object, such as a table leg 27, and clipping the locking clip 17 back onto the cable 13. The resulting loop then secures the cable 13 to the stationary object, thereby providing an anchor for the purse alarm. The housing 11 remains affixed to the protected goods. The alarm sounds by the pulling of the cable, turning the wheel in the housing 11 which activates a mechanical sound making device 18.

Figure 2:
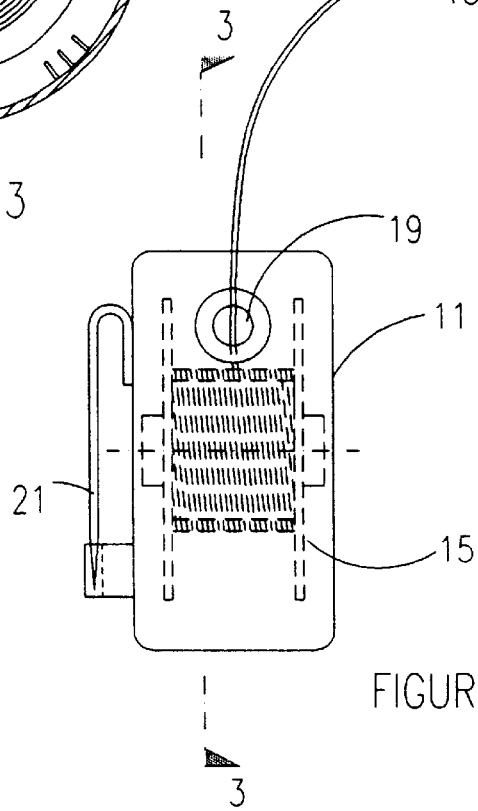
FIG. 2 is an end plan view showing the internal reel arrangement of the purse alarm of FIG. 1.

In FIG. 2, the housing 11 is seen having a cylindrical shape, although the housing 11 can be made in any shape sufficient to hold the reel 15. The housing 11 can be made of any rigid material that is easy and cost-effective to manufacture. A reel 15 is centrally located within the housing 11, and provides storage for the cable 13. Also, the reel 15 can take back the cable 13 through a reel spring activated retraction mechanism. The cable 13 can either be kept under constant retractable tension, or can be locked into a drawn out position. Pulling out the cable 13 overrides the reel spring and reverses the reel 15, which permits the unwinding of the cable 13.

The cable 13 can be constructed of any strong flexible material. Ideally the cable 13 should be of a sufficient thickness to provide strength, but thin enough to easily wind up on the reel 15. While cable resembling fishing line was described above, a braided filamentary cable involving different materials may provide more strength, such as a steel and nylon braided cable. A braided cable may also have a more attractive appearance. In operation, the cable 13 passes from the reel 15 through the port 19 and then out of the housing 11. The locking clip 17, which enables the attachment of the cable 13 to a table leg 27 or other substantial object, is permanently attached to the external end of the cable 13. When not in use, the cable 13 resides entirely on the reel 15, with only the locking clip 17 visible on the exterior of the housing 11.

A loud audio alarm is contained in the housing 11. It can be fabricated of any of the sound making device found in the marketplace, such as those commonly found in alarm clocks or toys. In order to have the desired effect, the audible alarm signal should have a decibel level sufficient to both alert the owner of the goods and to startle and scare the thief.

Figure 3:
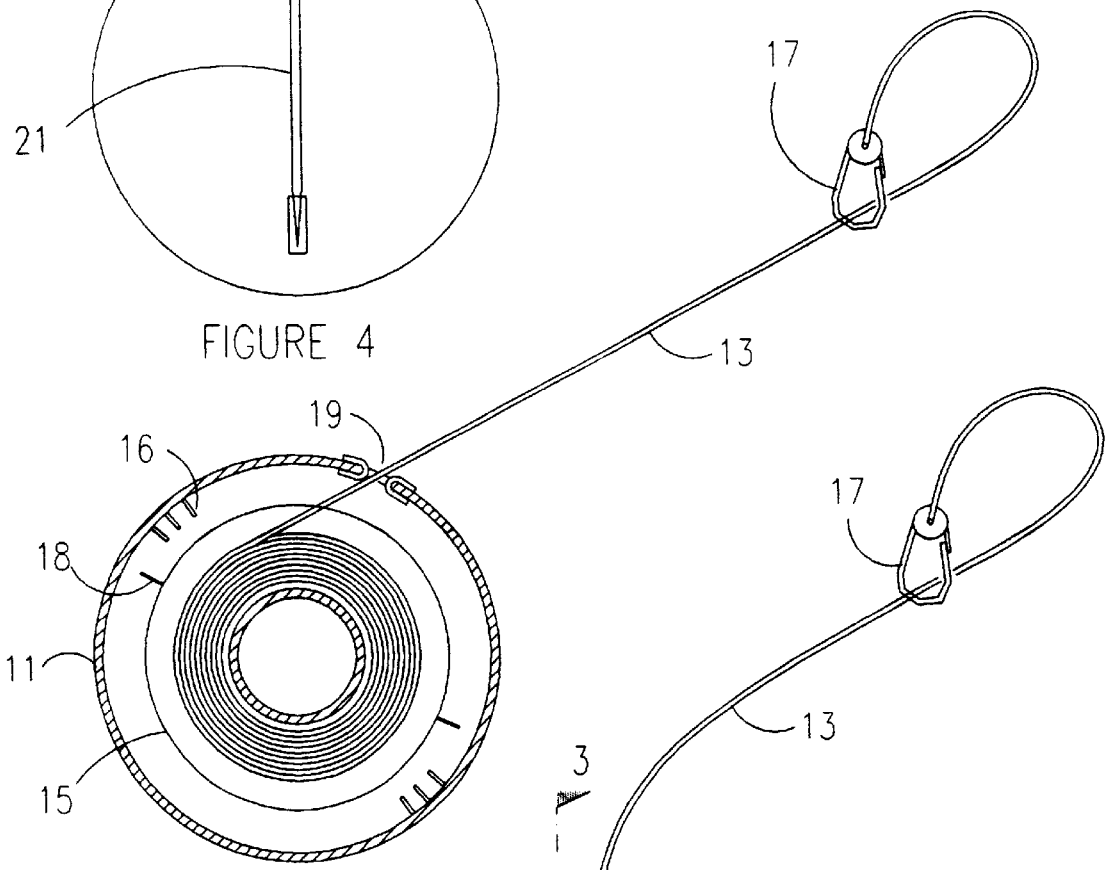
FIG. 3 is a cross-sectional view taken along line 3—3 of FIG. 2.

In FIG. 3, the reel 15, wound with the cable 13, can be seen in the center of the housing 11 adjacent to alarm devices 16 and 18. The cable 13 is viewed exiting the housing through the port 19, and terminating at the locking clip 17.

Figure 4:
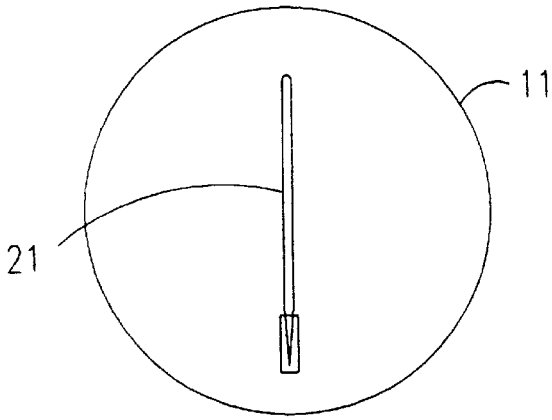
FIG. 4 is a side view of the purse alarm of FIG. 2.

In FIG. 4, clasp 21 is seen affixed to the exterior of the housing 11, which allows the device to be mounted to the purse 25. Preferably, the apparatus would be mounted to the inside of the purse 25, which would increase the level of security. The device would be hidden from view and circumvention of the purse alarm would be far more difficult.

What is claimed is:

1. A purse alarm comprising:

a housing having the size of a measuring tape having a clasp for attachment to personal belongings, a cable connected at one end to a reel disposed inside the housing, and having a clip at an exterior terminus of the cable for attachment of the cable to a fixed object, a reel contained in the housing with a spring for retracting the cable, and an alarm device coupled to the reel in the housing that sounds an alarm when the cable is being pulled.

2. The purse alarm of claim 1 wherein said clasp is a brooch pin.

3. The purse alarm of claim 1 wherein the alarm device is mechanically operated.

4. A purse alarm comprising:

a housing having the size of a measuring tape having a clasp for attachment to personal belongings, a cable connected at one end to a reel disposed inside the housing, and having a clip at an exterior terminus of the cable for attachment of the cable to a fixed object, and a reel contained in the housing with a spring for retracting the cable.

5. A purse alarm comprising a measuring tape sized housing with a reel contained therein, a cable retractably wound about said reel, a clip used to attach the cable to a fixed object, an audible alarm means within the housing for alerting the user of pulling of the cable.

6. The purse alarm of claim 5 wherein the housing has a clasp for attachment to personal belongings.

* * * * *